US006240937B1

(12) United States Patent
Salda

(10) Patent No.: US 6,240,937 B1
(45) Date of Patent: Jun. 5, 2001

(54) RECOVERY DEVICE

(75) Inventor: Luciano Salda, Vignola (IT)

(73) Assignee: C.M.S. SpA, Marano (IT)

( * ) Notice: Subject to any disclaimer, the term of this patent is extended or adjusted under 35 U.S.C. 154(b) by 0 days.

(21) Appl. No.: 09/155,572

(22) PCT Filed: Apr. 1, 1997

(86) PCT No.: PCT/EP97/01638

§ 371 Date: Apr. 26, 1999

§ 102(e) Date: Apr. 26, 1999

(87) PCT Pub. No.: WO97/37330

PCT Pub. Date: Oct. 9, 1997

(30) Foreign Application Priority Data

Apr. 1, 1996 (DE) ..... 296 06 053

(51) Int. Cl.[7] ..... B08B 3/02

(52) U.S. Cl. ..... 134/62; 134/83; 134/152; 134/166 R

(58) Field of Search ..... 134/62, 83, 152, 134/166 R, 169 R, 134; 198/402

(56) References Cited

U.S. PATENT DOCUMENTS

| | | | | |
|---|---|---|---|---|
| 759,349 | * | 5/1904 | Clifford . | |
| 2,585,697 | * | 2/1952 | Sommer et al. . | |
| 2,734,213 | * | 2/1956 | Ashford . | |
| 3,275,122 | * | 9/1966 | Carlson . | |
| 3,447,696 | * | 6/1969 | Calistrat . | |
| 3,567,008 | * | 3/1971 | Fischer . | |
| 3,583,414 | * | 6/1971 | Rose et al. | 134/83 |
| 3,768,493 | * | 10/1973 | Kraeft | 134/62 |
| 3,798,065 | * | 3/1974 | Kitterman et al. | 134/62 |
| 3,861,409 | * | 1/1975 | Taniguchi . | |
| 4,667,690 | * | 5/1987 | Hartnig | 134/62 |
| 4,803,055 | * | 2/1989 | Ueda | 134/62 |
| 5,161,661 | | 11/1992 | Hammond . | |
| 5,464,032 | * | 11/1995 | Litterst . | |

FOREIGN PATENT DOCUMENTS

| | | | | |
|---|---|---|---|---|
| 269674 | * | 6/1968 | (DE) | 134/62 |
| 41 26 260 | | 12/1992 | (DE) . | |
| 43 11 845 | | 10/1994 | (DE) . | |
| 0 655 715 | | 5/1995 | (EP) . | |
| 0 723 253 | | 7/1996 | (EP) . | |

* cited by examiner

*Primary Examiner*—Frankie L. Stinson
(74) *Attorney, Agent, or Firm*—Burns, Doane, Swecker & Mathis, L.L.P.

(57) ABSTRACT

A utilization device for used, stackable receptacles, in particular cups, comprises a guide path arranged at least between a first and a second processing means for the receptacles and supporting said receptacles. Said guide path is formed substantially above a reception opening of the second processing means with a tilting device for tilting each receptacle from the guide path towards said reception opening.

For simplifying the structural design of the tilting device and for making said tilting device reliable in use, it is implemented as an area of the guide path in which said guide path is provided with a tilting aperture, which is open substantially towards the reception opening and towards one side of the guide path, and with a rim guide means supporting a rim portion of the receptacle, said rim portion being arranged opposite the reception opening.

21 Claims, 4 Drawing Sheets

RECOVERY DEVICE

The present invention refers to a utilization device for used, stackable receptacles, in particular cups, comprising a guide path arranged at least between a first processing means and a second processing means for the receptacles and supporting said receptacles, said guide path being formed substantially above a reception opening of the second processing means with a tilting device for tilting each receptacle from the guide path towards said reception opening.

A utilization device of this type is generally disclosed in European patent application No. 94830165 of the same applicant. The utilization device serves e.g. for receiving recyclable receptacles which are supplied to the utilization device through an input opening. In the interior of this device, the receptacles, in particular cups, are moved along a transport path between various processing means. In the case of one processing means it is, for example, possible to detect the material of the receptacle by means of a suitable code of the receptacle so that the utilization or recycling in the following processing steps can be carried out according to the specific material of the receptacle in question.

Further processing means within the utilization device are e.g. a washing means for the receptacles, a pressing means for compressing the receptacles, a cutting means for reducing the receptacles in size, a stacking means for stacking and collecting the receptacles, or the like. Furthermore, the utilization device can be provided with a money dispensing unit for dispensing a reward for receptacles that have been returned. The utilization device can be used for plastic receptacles, receptacles or vessels of glass, aluminium or the like, one utilization device being sufficient for the utilization of all these different receptacles and vessels.

With regard to the description of a guide path between a processing means and especially a stacking device used for stacking and collecting receptacles, reference is made to European patent application No. 94830589 in which a detail solution for a utilization device of the kind mentioned hereinbefore is shown.

With regard to the closest prior art, reference is made to European patent application No. 95830016 describing a utilization device which has the features of the generic clause of claim 1 and in the case of which receptacles transported along the guide path are tilted by means of a tilting device from said guide path towards a reception opening of the second processing means. The second processing means is in this case a stacking device.

This known solution is disadvantageous insofar as the tilting device has a comparatively complicated structural design due to the fact that a deflection rod and a tilting rod are additionally used, separately from the guide path. By means of the deflection rod, a receptacle, in particular a cup, moving along the guide path is deflected laterally relative to the direction of movement along said guide path. The tilting rod defines an obstacle to the laterally deflected receptacle so that the receptacle tilts over said tilting rod in the direction of the reception opening of the stacking device and leaves the guide path. In this kind of arrangement, it is, for example, also important that the deflection rod and the tilting rod are precisely oriented and arranged relative to one another.

Hence, it is the object of the present invention to improve a utilization device of the type mentioned at the beginning in such a way that the tilting device has a simple structural design and is reliable in use.

In the case of a utilization device having the features of the generic clause of claim 1, this object is achieved by the features that the tilting device is implemented as an area of the guide path in which said guide path is provided with a tilting aperture, which is open substantially towards the reception opening, and with a rim guide means supporting a rim portion of the receptacle, said rim portion being arranged opposite the reception opening.

Due to the fact that the receptacle is then only supported in a rim portion which is arranged opposite the reception opening and the rest of the receptacle is located in the area of the tilting aperture, the receptacle tilts automatically in the direction of the reception opening away from the guide path. Positive guidance of the receptacle by means of a deflection rod or positive tilting of the laterally deflected receptacle by a suitable tilting rod is not required. The structural design of the utilization device and especially that of the tilting device are simplified in this way, and it is guaranteed that the receptacle will tilt from the guide path in the direction of the reception opening of the stacking device without any necessity of observing a special orientation of the elements defining the tilting device.

The guide path can, for example, be implemented as a flat belt along which the receptacles are advanced in the form of an uninterrupted row of receptacles. In this case, the respective last receptacle supplied to the row of receptacles will push the row forwards and, when the row is long enough, the first receptacle of the row will reach the tilting device and tilt towards the reception opening of the stacking device or second processing means.

It is also possible to move each receptacle separately and alone along the guide path; in this case, the utilization device comprises e.g. at least one feed device, which is adapted to be moved along the guide path and which encloses the receptacle at least partially, said feed device being formed with a tilt-out opening located on the side of the reception opening. As soon as the feed device has reached the tilting device, the receptacle will tilt through said tilt-out opening towards the reception opening.

The feed device can move straight along the guide path or it can be supported such that it is rotatable about a horizontal axis, the guide path being arranged in radially spaced relationship with the feed device and the receptacle being guided along a transport path having substantially the shape of a circular arc or of a circle. This can be done e.g. in such a way that the feed device takes up a receptacle at the uppermost point of the transport path, moves said receptacle along the guide path and discharges it at the lowermost point of the transport path or, further on, via the tilting device. In this connection, it should be taken into account that the feed device need not hold the receptacle, but that the receptacle is held between the feed device and the guide path.

Instead of using a flat belt for the guide path, said guide path can also have a raillike structural design; according to an advantageous embodiment, it is defined by two spaced rails whose distance is smaller than a respective width of the receptacle. The receptacle can be in contact with the guide path via the upper or the lower receptacle end and it can be moved along said guide path by the feed device.

When a raillike guide path is used, the tilting device can be simplified in that the tilting aperture is implemented as an interrruption of the rail located closest to the reception opening. By means of this interruption or gap provided in one of the rails and the use of the other rail as a rim guide means for the receptacle, a tilting device is obtained which is easy to produce and reliable in operation.

The use of a raillike guide path is also advantageous in cases where the first processing means is a washing means for cleaning the interior of the receptacle. This has the effect that, especially when the receptacle is arranged such that its receptacle opening faces the guide path, cleaning liquid, such as water, which may still be contained in the receptacle can easily flow out between the rails. The receptacle abuts on the rails only with rim portions of the receptacle opening and is moved along the rails by means of the feed device. In this connection, it will be advantageous to arrange the washing means at the lowermost point of the circular transport path, since, in this way, the cleaning liquid sprayed into the interior of the receptacle can directly flow out at the bottom through the receptacle opening. In addition, residual cleaning liquid can flow out when the receptacle continues its movement along the rails.

It will be advantageous when a chute is arranged essentially between the tilting aperture and the reception opening so that the receptacles can be supplied to the stacking device purposefully and in a guided manner. The receptacle, which is turned upside-down in view of the above-mentioned arrangement of the washing means, is tilted by means of the tilting device in such a way that it slides with its lower end along the chute in the direction of the reception opening of the stacking device. In the interior of the stacking device, the receptacles are then stacked one on top of the other in the manner known.

When the receptacle moves along the guide path at a position at which the receptacle opening faces upwards, the receptacles can also be supplied upside-down to the stacking device via the tilting device and the chute so that they will be stacked in the stacking device upside-down.

At least in the end portion facing the tilting aperture, the chute has a channellike structural design and is provided with a tilt-in opening that is open in the direction of the tilting aperture so that the receptacles can be tilted into the chute more easily.

In this connection it will also be advantageous when the chute has a tubular structural design at least in its lower end portion associated with the reception opening so that the receptacles can reliably be supplied to the reception opening of the stacking device.

For preventing a turning of the receptacle, when the receptacles are tilted into the tilt-in opening of the chute, and an incorrect association with the receptacles that have already been stacked, it will be advantageous when, at the upper end of the tubular end portion, an introduction guide projects which is curved upwards substantially in the direction of the guide path. This introduction guide can be implemented as an integral or as a multi-part or e.g. as a latticed component. The material used for said introduction guide is a material with suitable corrosion resistance.

In particular in connection with a washing means, it proves to be advantageous when the tilting aperture, the stacking device and the chute are arranged adjacent the lowermost point of the transport path and downstream of the washing means.

In accordance with a simple embodiment of the stacking device, said stacking device comprises a substantially vertical stacking tube having an upper reception opening, the chute extending from said reception opening at an oblique angle upwards towards the tilting aperture. In the interior of the stacking tube, the receptacles supplied are accurately supplied to already stacked receptacles for further stacking.

The chute is cut off at an oblique angle at its lower end facing the reception opening so that the receptacles on the chute can be supplied more easily to the reception opening, the cutting angle being approx. between 30 and 60°, preferably 45°.

The formation of a drip opening in the lower surface of the chute will be advantageous so as to prevent e.g. cleaning liquid from the guide path or from the tilted receptacle from being conducted by means of the chute in the direction of the stacking device.

In accordance with a simple embodiment, the drip opening is substantially V-shaped, a projection protruding into the V-opening being implemented as a drip edge.

In the European patent application No. 95830016, a container, which constitutes part of the stacking device and which serves to receive therein receptacles stacked in the stacking tube, is arranged below the stacking tube, said stacking tube being at least two-dimensionally movable along guide means above said container. For stacking a predetermined number of receptacles in the stacking tube and for supplying them then to the container, the stacking tube has formed thereon a holding means for releasably holding a number of stacked receptacles.

The stacking tube and/or the chute has/have associated therewith at least one detection means, especially a photocell, for detecting when one of the receptacles dropped has missed the stacking tube or when one of the receptacles has got stuck between the chute and the stacking tube or for detecting a predetermined number of stacked receptacles.

For receiving a plurality of stacks of receptacles, the container is provided with a plurality of subdividing means of such a nature that they can receive therein stacks of receptacles separately from one another. The subdividing means are releasably arranged in the container so that, when the container has been filled, said subdividing means can be removed and re-inserted into an empty container.

Instead of supplying the receptacles to the stacking device, the chute can also supply the receptacles to a pressing or cutting means.

The washing means is preferably arranged at a rotational angle of 50° to 70°, preferably 60°, ahead of the tilting device, when seen in the direction of rotation of the feed device, so as to guarantee that most of the cleaning liquid flows out of the interior of the receptacle and that said cleaning liquid is not, or only to an insignificant extent entrained up to the chute. The tilting device is in this connection located at the lowermost point of the transport path having the shape of a circular arc.

In addition, a collecting receptacle for the cleaning liquid is preferably arranged between the washing means and this lowermost point; this collecting receptacle may be connected to a reservoir for the liquid so as to recirculate the cleaning liquid. In order to prevent contaminations which have been washed out of the receptacles from being recirculated into the reservoir, a suitable filter means may, for example, be arranged between the collecting receptacle and the reservoir.

The materials used may, for example, be a plastic material for the chute, a metal for the introduction guide and a cardboard material for the container including the subdividing means.

In the following, an advantageous embodiment of the present invention will be explained and described in detail making reference to the figures added in the drawings, in which.

Figure 1:
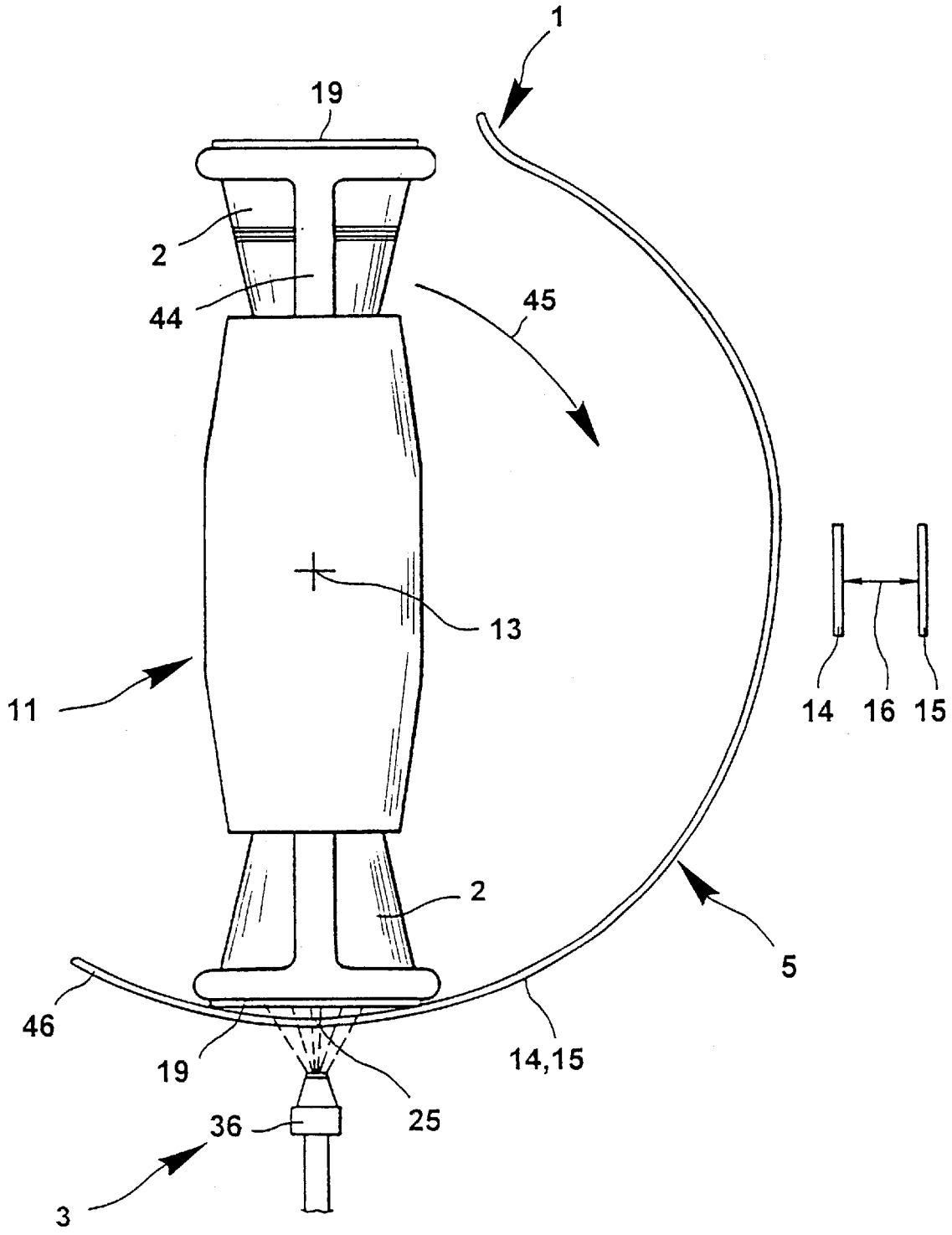
FIG. 1 shows a processing means of a utilization device including a guide path according to the present invention.

FIG. 1 shows a processing means 3 of an utilization device 1. This processing means is a washing means provided with a water nozzle 36 for injecting a cleaning liquid into a receptacle opening 19 of a receptacle 2.

For guiding the receptacles 2 to said processing means 3, a feed device 11 is provided, which is supported such that it is rotatable about a horizontal axis 13. Holders 44 are arranged at the diametrically opposed ends of said feed device 11, said holders 44 encompassing the receptacle 2 in the area of its opening 19 at least partially.

The upper holder 44 according to FIG. 1 is adapted to have supplied thereto the receptacles 2 from a further processing means, which is not shown, or directly from an input opening. By rotating the feed device 11 in clockwise direction 45, the receptacles can be supplied to the washing means 3, which acts as a processing means, along a substantially semicircular guide path 5. During said supply, a rim of the receptacle 2 surrounding the receptacle opening 19 is held between the holder 44 and the guide path 5. The guide path 5 is defined by two parallel, spaced rails 14 and 15, which are schematically shown on the right hand side of FIG. 1, said rails being arranged at a distance 16 from one another.

Figure 2:
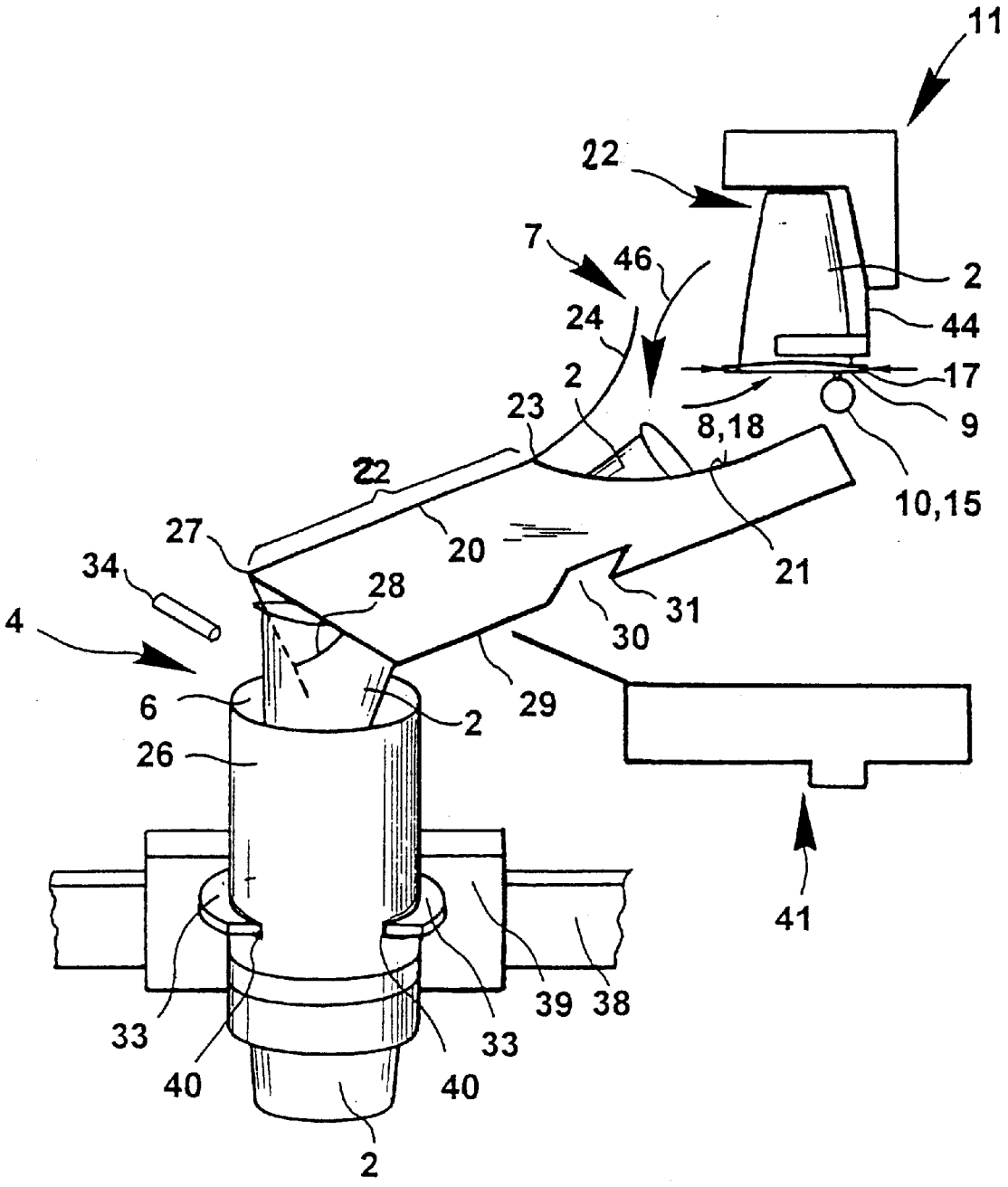
FIG. 2 shows a schematic representation of a tilting device followed by a stacking device.

FIG. 2 shows a schematic representation of a part of the guide path 5, said part being located subsequent to the processing means 3 in the interior of the utilization device 1 when seen in the direction of movement 45. The feed device 11 is only shown partially. FIG. 2 especially shows that the holder 44 releases the receptacle 2 on a side associated with a stacking device 4, which constitutes a further processing means 3, so that the receptacle 2 can tilt out of the holder 44 by means of a tilting device 7 along direction 46.

The tilting device 7 is defined by a tilting aperture 8, a rim guide means 10 and a chute 20.

In the embodiment according to FIG. 1 and 2, the tilting aperture 8 is defined by an interruption 18 of the rail 14. In addition, the rail 14 can end in front of the rail 15, when seen in the direction of rotation 45, so that the tilting aperture is formed after the end of rail 14.

The rim guide means 10 supports a rim portion 9 of the receptacle 2, which is located opposite the tilting aperture 8, and is defined by the right rail 15 according to FIG. 1.

Due to the one-sided support of the receptacle 2, said receptacle tilts about the rim guide means 10 in direction 46 towards the chute 20 due to the effect of the force of gravity. For receiving the receptacle 2 on the chute 20, an upper end portion of said chute 20 has a channellike structural design and is provided with an upper tilt-in opening 21, said upper end portion being associated with the tilting aperture 8 or interruption 18. The chute 20 extends at an oblique angle downwards in the direction of the stacking device 4. A lower end portion 22 of the chute 20 has a tubular structural design, said lower end portion 22 being associated with the reception opening 6 of the stacking device 4. The lower end 27 of said lower end portion 22 is arranged above the reception opening 6. This lower end 27 is cut off at an oblique angle, the respective cutting angle 28 being 45° in the embodiment shown. Depending on the inclination of the chute 20 and the diameter of the tubular end portion 22, the cutting angle may also be 30 to 60°.

At the upper end 23 of the tubular end portion 22, a curved introduction guide 24 projects upwards. This introduction guide 24 partially delimits the tilt-in opening 21 upwards.

In a lower surface 29 of the chute 20, a drip opening 30 is provided. This drip opening 30 is substantially V-shaped, the V-tip being directed towards the lower end 27 of the chute 20. Between the V arms, a drip edge 31 is defined from which cleaning liquid from the washing means 3 according to FIG. 1, which is entrained by the objects moving along the chute 20, flows off into a collecting receptacle 41 arranged below the chute 20.

In FIG. 2, a receptacle 2 is shown between the chute 20 and a stacking tube 26 of the stacking device 4. This receptacle 2 is detected and registered by a detection means 34.

The stacking tube 26 has a circular cross-section, the diameter of said stacking tube 26 being larger than the width 17 of the receptacle 2 at its receptacle opening 19, cf. also FIG. 1.

In the interior of said stacking tube 26., a predetermined number of receptacles 2 can be stacked, a lowermost receptacle 2 projecting beyond said stacking tube 26 at the bottom. For holding the stacked receptacles 2 in the interior of the stacking tube 26, said stacking tube 26 is provided with a holding means 33. Said holding means 33 comprises at least two holding arms which are radially displaceable in horizontal slots 40 of the stacking tube 26 and which engage from below a rim surrounding the receptacle opening 19 of the lowermost of the stacked receptacles 2.

The stacking tube 26 is adapted to be moved along a transverse guide 38 by means of a movable drive or slide 39.

To simplify matters, neither the tilting device 7 nor the stacking device 4 of FIG. 2 are shown in FIG. 1. It should, however, be mentioned that these components are located downstream of the washing means 3, e.g. a short distance before the end 46 of the guide path 5, when seen in the direction of rotation 45 of the feed device 11 according to FIG. 1.

Figure 3:
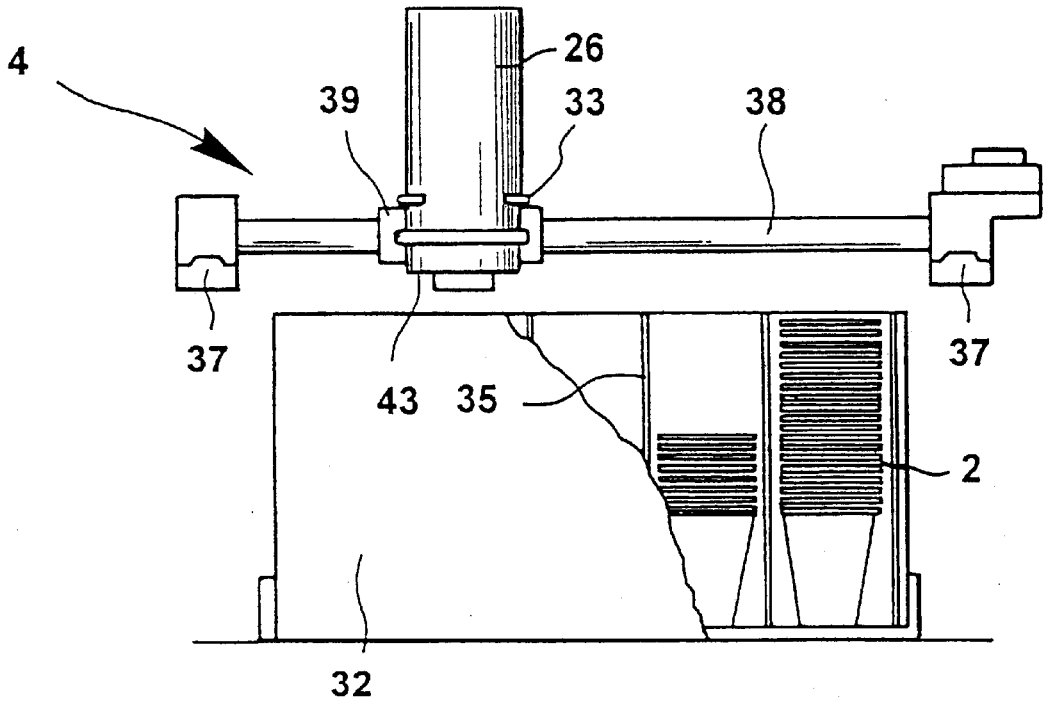
FIG. 3 shows a side view, partly broken away, of a stacking device and a collecting container.

FIG. 3 shows a side view, partly broken away, of the stacking device 4. The stacking tube 26 including the holding means 33 is adapted to be moved along the transverse guide 38 by means of the slide 39, cf. also FIG. 2. The transverse guide 38 is adapted to be moved along longitudinal guides 37 by means of a suitable drive, said transverse guide 38 and said longitudinal guides 37 extending at right angles to one another. By means of the transverse guide 38 and the longitudinal guides 37 and the respective drives, the stacking tube 26 is adapted to be moved substantially two-dimensionally above a container 32.

The container 32 has subdividing means 35 in the interior thereof. These subdividing means define the boundaries of a plurality of compartments 42, cf. FIG. 4, each of said compartments accommodating a predetermined number of stacked receptacles 2.

Figure 4:
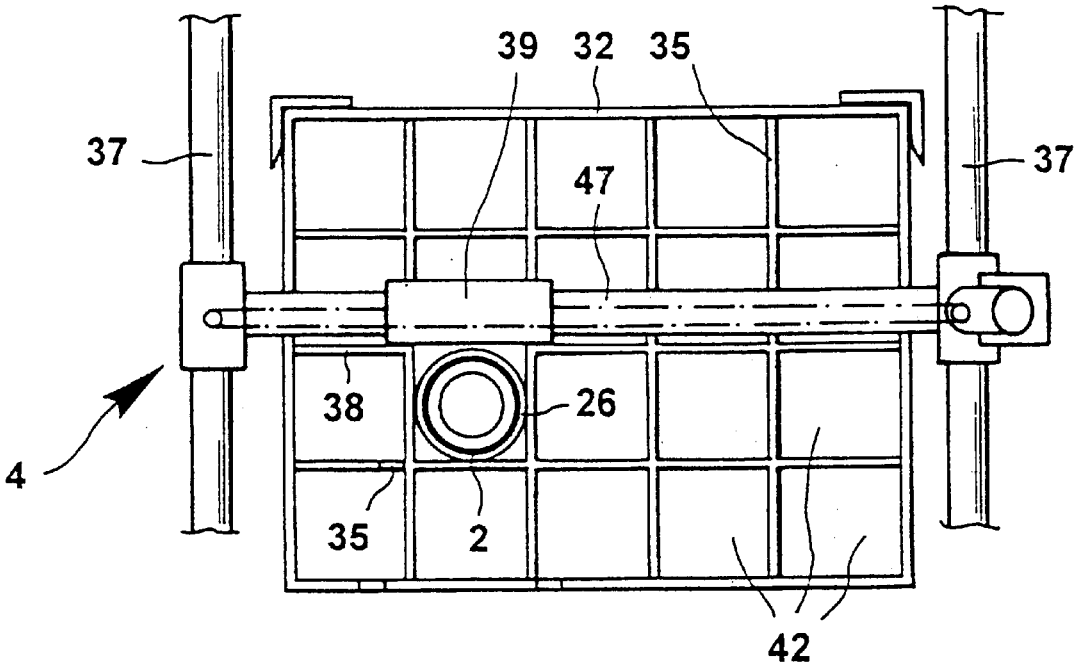
FIG. 4 shows a top view of a stacking device and of a collecting container according to FIG. 3.

In FIG. 4 a top view of the stacking device 4 according to FIG. 3 is shown.

The transverse guide 38 extends between the two longitudinal guides 37, the slide 39 being adapted to be moved along said transverse guide 38 by means of an endless belt 47 circulating between said longitudinal guides 37. The slide 39 may also be provided with a drive of its own, e.g. in the form of an electric motor. The ends of the transverse guide 38 have assocaited therewith at least one further drive for moving said transverse guide 38 in the direction of the longitudinal guides 37.

The container 32 has a substantially rectangular cross-section, subdividing means 35 in the interior of said container defining a plurality of compartments 42 having a substantially square cross-section. The subdividing means 35 can be removed from the container 32 as a unit.

The stacking tube 26, in the interior of which receptacles 2 are stacked, is arranged above one of the compartments 42.

Figure 5:
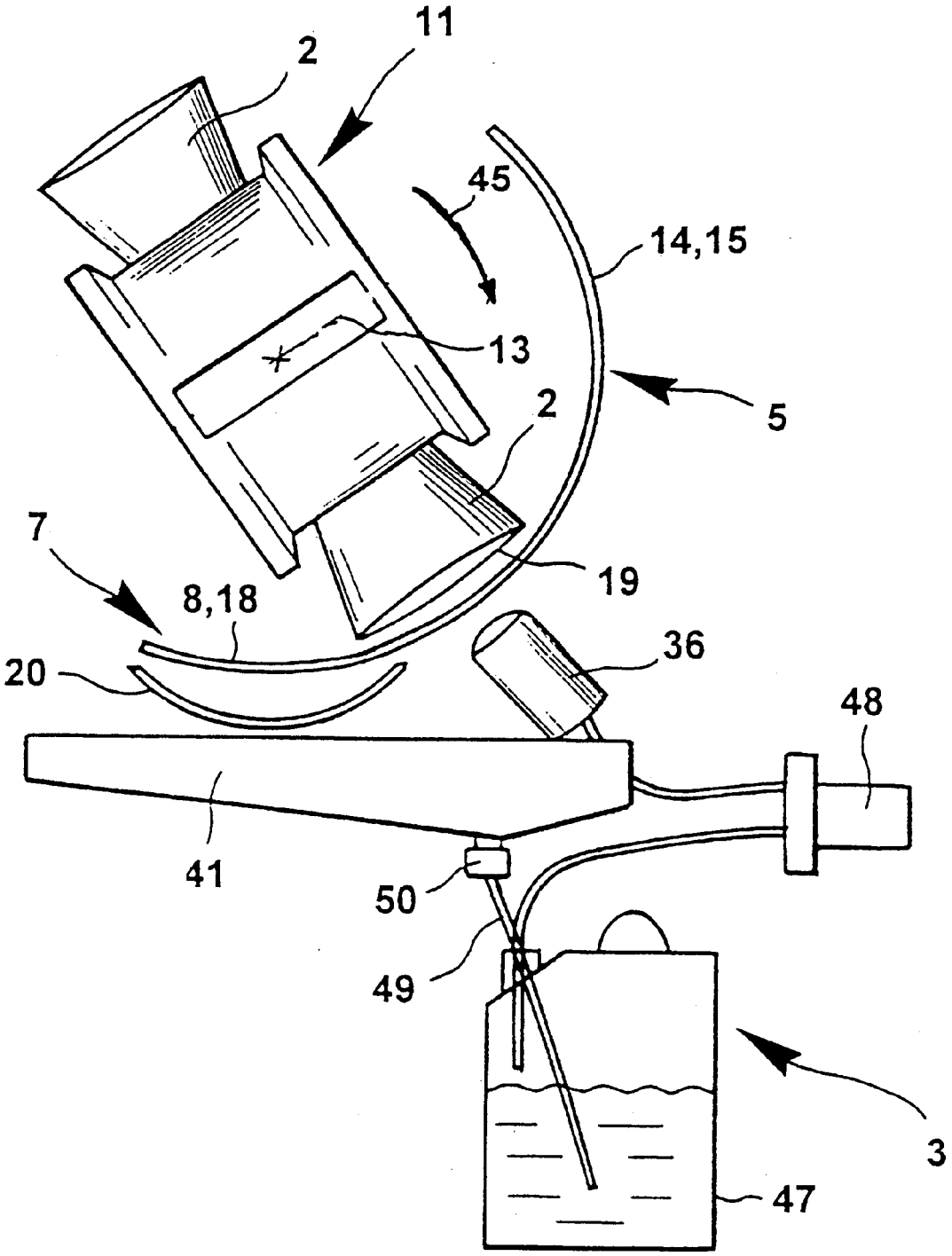
FIG. 5 shows a further embodiment of a processing means of a utilization device including a guide path according to the present invention.

FIG. 5 shows a further embodiment of a washing means constituting a processing means 3 of the utilization device according to the present invention. Identical components are designated by identical reference numerals, and only part of these components are mentioned.

Other than in the case of the embodiment according to FIG. 1, the washing means 3 is arranged, when seen in the direction of rotation, approximately 60° before the lowermost point of the guide path 5 defined by the rails 14, 15. A water nozzle 36 is arranged in opposed relationship with a receptacle opening 19; by means of said water nozzle 36, water can be supplied as a cleaning liquid from a reservoir 47 by means of a pump 48 and suitable conduits for cleaning the interior of the receptacle.

In addition, a collecting receptacle 41 communicates with the reservoir 47 via a supply line 49, said collecting receptacle 41 extending approximately from a location below the water nozzle 36 to a location below the tilting device 7 at the lowermost point of the guide path 5. By means of this collecting receptacle 41, water flowing out of the interior of the receptacle 2 can be resupplied to the reservoir 47 via the line 49 and, if desired, an intermediate filter 50.

In the area of the tilting device 7 a rail, i.e. the rail 14, cf. FIG. 1, is interrupted or ends before the rail 15, which has the effect that the receptacle 2 is now only supported at a rim portion of its receptacle opening 19 and tilts therefore towards the chute 20 about the rail 15 acting as a pivot point, cf. also FIG. 2. In so doing, the receptacle 2 slides, its closed end first, towards the respective stacking device 4 according to FIG. 2 or towards some other processing station, such as a pressing or cutting station.

In the following, the mode of operation of the utilization device according to the present invention will be described briefly.

The receptacles 2 are advanced along the guide path 5 by means of the feed device 11, a rim, which surrounds the receptacle opening 19, being held between holders 44 and the rails 14, 15 defining the guide path 5. In the embodiment shown, the feed device 11 is provided with two diametrically opposed holders for receiving a receptacle 2. It goes without saying that also more than two hoders can be arranged along the direction of rotation 45 in a uniformly spaced manner.

At the lowermost point of the guide path 5, the receptacles 2 are turned upside-down so that their opening is directed towards a water nozzle 36 of the washing means 3. By injecting a cleaning liquid, in particular water, the interior of the receptacle is cleaned. This can be done while the feed device 11 continues its movement in the direction of rotation 45 without any interruption.

The stacking device 4 is arranged subsequent to the washing means 3, when seen in the direction of rotation 45. For the purpose of tilting the receptacles 2 from the guide path 5 in the direction of the stacking device 4, the tilting device 7 is implemented as shown in FIG. 2.

The tilting device is substantially defined by a tilting aperture 8 in the area of the guide path 5. Due to said tilting aperture 8, the receptacles are only supported in a rim portion 9 by the rail 15 so that they tilt out of the holders 44 in the direction of the chute 20 to the left in FIG. 2. The tilting device is implemented such that the receptacles slide, the closed end first, along the chute 20 towards the stacking device 4.

The stacking device 4 consists essentially of a stacking tube 26 in the interior of which the receptacles 2 are stacked so as to form a receptacle stack of predetermined height. Subsequently, the stack of receptacles is transferred to a respective compartment 42 in the container 32 according to FIG. 3 and 4.

When the container 32 is full, it can be removed from the utilization device. The subdividing means 35 can be removed from the container 32 and inserted into a new, empty container 32, which is then re-inserted into the utilization device.

Alternatively, the washing means 3 can also be arranged according to FIG. 5 at a rotational angle of approximately 60° before the lowermost point of the guide path 5. At this point, the water used as a cleaning liquid is injected into the interior of the receptacle and in the course of the subsequent rotary movement down to the lowermost point of the guide path 5 most of the water will flow out of the interior of said receptacle. At this lowermost point of the guide path, the tilting device 7 is arranged, the respective receptacle tilting from the guide path 5 onto the chute 20 due to the interruption 18 of a rail 14 acting as a tilting aperture 8, whereupon it is transferred, the closed receptacle end first, along said chute e.g. to the stacking device 4 according to FIG. 2.

What is claimed is:

1. A utilization device for used, stackable receptacles, comprising a guide path arranged at least between a first and a second processing means for the receptacles and supporting said receptacles, said guide path being formed substantially above a reception opening of the second processing means with a tilting device for inverting each receptacle from the guide path towards said reception opening, wherein the tilting device includes a portion of the guide path in which a portion of a tilting aperture is arranged with, which is open substantially towards the reception opening and towards one side of the guide path, and with a rim guide means supporting a rim portion of the receptacle, said rim portion being arranged opposite the reception opening.

2. A utilization device according to claim 1, characterized in that the utilization device comprises at least one feed device, which is adapted to be moved along the guide path and which encloses the receptacle at least partially, said feed device being formed when a tilt-out opening located on the side of the reception opening.

3. A utilization device according to claim 2, characterized in that the feed device is supported such that it is rotatable about a horizontal axis and that the guide path is arranged in radially spaced relationship with the feed device, the receptacle being guided along a transport path having substantially the shape of a circular arc.

4. A utilization device according to claim 1, characterized in that the guide path is defined by two spaced rails whose distance is smaller than a respective width of the receptacle.

5. A utilization device according to claim 1, characterized in that the tilting aperture is implemented as an interruption of the rail located closest to the reception opening.

6. A utilization device according to claim 1, characterized in that the processing means is a washing means for cleaning the interior of the receptacle, and that the receptacle is arranged such that its receptacle opening faces the guide path.

7. A utilization device according to claim 1, the second processing means being a stacking device for stacking the receptacles supplied, characterized in that a chute is arranged essentially between the tilting aperture and the reception opening of the stacking device.

8. A utilization device according to claim 7, characterized in that, at least at its end portion facing the tilting aperture, the chute has a channel-like structural design and is provided with a tilt-in opening that is open in the direction of the tilting aperture.

9. A utilization device according to claim 8, characterized in that, at least in its lower end portion associated with the reception opening, the chute has a tubular structural design.

10. A utilization device according to claim 9, characterized in that, at the upper end of the tubular end portion, the chute is provided with a curved, upwardly projecting introduction guide which projects substantially towards the guide path.

11. A utilization device according to claim 9, characterized in that the chute is cut off at an oblique angle at its lower end facing the reception opening, the associated cutting angle being approx. 30 to 60°, preferably 45°.

12. A utilization device according to claim 11, characterized in that the chute is provided with a drip opening in the lower surface thereof.

13. A utilization device according to claim 12, characterized in that the drip opening is substantially V-shaped, a projection protruding into the V-opening being implemented as a drip edge.

14. A utilization device according to claim 11, a container, which constitutes part of the stacking device and which serves to receive therein stacked receptacles, being arranged below the stacking tube and said stacking tube being supported such that it is at least two-dimensionally movable above said container, characterized in that the stacking tube has formed thereon a holding means for releasably holding a number of stacked receptacles.

15. A utilization device according to claim 14, characterized in that the stacking tube and/or the chute has/have associated therewith a detection means, especially a photocell.

16. A utilization device according to claim 14, the container having formed therein a plurality of subdividing means so as to receive therein stacks of receptacles separately from one another, characterized in that the subdividing means are releasably arranged in the container.

17. A utilization device according to claim 7, characterized in that the tilting aperture, the second processing means and the chute are arranged adjacent the lowermost point of the transport path of the feed device or of the guide path.

18. A utilization device according to claim 17, wherein the second processing means is a stacking device.

19. A utilization device according to claim 18, characterized in that the stacking device comprises a substantially vertical stacking tube having an upper reception opening, and that the chute extends from said reception opening at an oblique angle upwards towards the tilting aperture.

20. A utilization device according to claim 1, characterized in that, when seen in the direction of rotation, a washing means as the first processing means is arranged approx. 50° to 70°, preferably 60°, ahead of the tilting device which is located essentially at the lowermost point of the transport path having the shape of a circular arc.

21. A utilization device according to claim 20, characterized in that a collecting receptacle for collecting cleaning liquid flowing out of the receptacles is arranged below the rails and connected to a cleaning liquid reservoir.

* * * * *